United States Patent [19]

Watanabe et al.

[11] Patent Number: 4,564,587

[45] Date of Patent: Jan. 14, 1986

[54] LIGHT-SENSITIVE SILVER HALIDE COLOR PHOTOGRAPHIC MATERIAL COMPRISING MULTI-SILVER HALIDE EMULSION LAYERS HAVING SAME COLOR SENSITIVENESS BUT DIFFERENT IN SENSITIVITIES

[75] Inventors: Yoshikazu Watanabe; Kenji Ito, both of Hino, Japan

[73] Assignee: Konishiroku Photo Industry Co., Ltd., Tokyo, Japan

[21] Appl. No.: 629,361

[22] Filed: Jul. 10, 1984

[30] Foreign Application Priority Data

Jul. 20, 1983 [JP] Japan ..... 58-133491

[51] Int. Cl.[4] ..... G03C 1/08; G03C 1/46

[52] U.S. Cl. ..... 430/505; 430/506; 430/507; 430/509; 430/957

[58] Field of Search ..... 430/505, 509, 507, 506, 430/957

[56] References Cited

U.S. PATENT DOCUMENTS

| | | | |
|---|---|---|---|
| 3,843,369 | 10/1974 | Kumai et al. | 430/509 X |
| 4,003,744 | 1/1977 | Kliem | 430/509 X |
| 4,145,219 | 3/1979 | Kato et al. | 430/502 |
| 4,170,479 | 10/1979 | Usami | 430/509 |
| 4,186,011 | 1/1980 | Lohmann et al. | 430/505 |
| 4,374,914 | 2/1983 | Mollet et al. | 430/505 X |
| 4,481,288 | 11/1984 | Yamada et al. | 430/509 X |

FOREIGN PATENT DOCUMENTS

| | | |
|---|---|---|
| 1134818 | 11/1982 | Canada . |
| 923045 | 4/1963 | United Kingdom . |
| 2010818 | 4/1979 | United Kingdom . |

*Primary Examiner*—John E. Kittle
*Assistant Examiner*—Mukund J. Shah
*Attorney, Agent, or Firm*—Frishauf, Holtz, Goodman & Woodward

[57] ABSTRACT

Disclosed is a light-sensitive silver halide color photographic material comprising at least one light-sensitive layer, which is constituted of a plurality of silver halide emulsion layers having substantially the same color sensitiveness but being different in sensitivities and contains a dye image-forming coupler, provided by coating on a support, said material being constituted so as to satisfy at the same time the requirements that (a) said plurality of silver halide emulsion layers in said light-sensitive layer are provided by coating in the order from the support side a low sensitivity emulsion layer, medium sensitivity emulsion layer and high sensitivity emulsion layer, (b) a non-sensitive intermediate layer is provided by coating between said low sensitivity emulsion layer and said medium sensitivity emulsion layer, (c) the density of a dye image-forming coupler in said medium sensitivity emulsion layer is 10 to 60% of the density of a dye image forming coupler in said low sensitivity emulsion layer; and (d) the maximum color-formed density (D) in said medium sensitivity emulsion layer is $0.6<D<1.2$.

18 Claims, No Drawings

LIGHT-SENSITIVE SILVER HALIDE COLOR PHOTOGRAPHIC MATERIAL COMPRISING MULTI-SILVER HALIDE EMULSION LAYERS HAVING SAME COLOR SENSITIVENESS BUT DIFFERENT IN SENSITIVITIES

BACKGROUND OF THE INVENTION

This invention relates to a light-sensitive silver halide color photographic material, more particularly to a light-sensitive silver halide color photographic material (hereinafter referred to merely as light-sensitive material) which is improved in graininess, sharpness and pressure fogging resistance of the image.

In the field of light-sensitive materials, development of light-sensitive materials having high sensitivity and containing micropulverized grains is strongly desired particularly in recent years, and a large number of improved light-sensitive materials for color photography have been proposed.

For instance, German Pat. No. 1,121,470 and U.K. Pat. No. 923,045 state that sensitivity can be enhanced without deterioration of graininess by providing by coating separately in layers a high sensitivity silver halide emulsion layer and a low sensitivity silver halide emulsion layer each containing a dye image forming coupler capable of color forming to substantially the same hue, and further controlling the maximum color-formed density of the above high sensitivity silverhalide emulsion level at a low level.

However, according to the method as mentioned above, the oxidized product of a p-phenylenediamine type color developing agent formed by development of coarse silver halide grains in the high sensitivity silver halide emulsion layer subjected to exposure does not remain within the above high sensitivity silver halide emulsion layer but migrates by diffusion to the adjacent low sensitivity silver halide emulsion layer having higher coupler density, where large dye grains are formed resulting in disadvantageous deterioration of graininess.

Also, in recent years, higher sensitization is increasingly demanded, and coarse silver halide grains inferior in graininess and a coupler with great coupling speed are obliged to be used in emulsion layers. Accordingly, graininess can necessarily be improved only insufficiently and it has been desired to make efforts for further improvement of graininess.

As a part of such improvement, for instance, Japanese Patent Publication No. 15495/1974 and Japanese Unexamined Patent Publication No. 7230/1978 disclose a method in which a medium sensitivity silver halide emulsion layer lower in color-formed density and a medium sensitivity silver halide emulsion layer containing a DIR compound are provided by coating between a high sensitivity silver halide emulsion layer and a low sensitivity silver halide emulsion layer.

However, these methods involve a drawback that the extent of improvement of graininess is insufficient in the gradation region where graininess is most conspicuous during photographing.

Further, Japanese Unexamined Patent Publication No. 155536/1982 states that a light-sensitive material excellent in both high sensitivity and graininess can be obtained by providing a non-sensitive intermediate layer containing a dye image forming coupler between a high sensitivity silver halide emulsion layer and a low sensitivity silver halide emulsion layer having light-sensitivity to substantially the same spectral region. However, even according to such a method, graininess in the medium density region where graininess is most conspicuous is not yet sufficient.

SUMMARY OF THE INVENTION

A first object of this invention is to provide a light-sensitive silver halide color photographic material which is highly sensitive and excellent in graininess, and its second object is to provide a light-sensitive color photographic material improved in pressure fogging resistance.

The present inventors have made various investigations and consequently found that the above objects can be accomplished by a light-sensitive silver halide color photographic material comprising at least one light-sensitive layer, which is constituted of a plurality of silver halide emulsion layers having substantially the same color sensitiveness but being different in sensitivity and contains a dye image forming coupler, provided by coating on a support, said material being constituted so as to satisfy the four requirements as specified below:

(a) said plurality of silver halide emulsion layers in said light-sensitive layer are provided by coating in the order from the support side low sensitivity silver halide emulsion layer, medium sensitivity silver halide emulsion layer and high sensitivity silver halide emulsion layer;

(b) a non-sensitive intermediate layer is provided by coating between said low sensitivity silver halide emulsion layer and said medium sensitivity silver halilde emulsion layer;

(c) the density of a dye image forming coupler in said medium sensitivity silver halide emulsion layer (namely, the content of a dye image forming coupler contained in said emulsion layer to a hydrophilic colloidal binder in said emulsion layer) is 10 to 60% of the density of the dye image forming coupler in said low sensitivity silver halide emulsion layer; and (d) the maximum color-formed density (D) in said medium sensitivity silver halide emulsion layer is $0.6<D<1.2$.

Thus, the light-sensitive color photographic material of this invention has at least one layer of a light-sensitive layer containing a dye image forming coupler provided on a support, and said light-sensitive layer is constituted so as to satisfy the requirements as specified above in (a) to (d) at the same time.

DETAILED DESCRIPTION OF THE INVENTION

In the light-sensitive material of this invention, the light-sensitive layer containing a dye image forming coupler is constituted of a plurality of silver halide emulsion layers (hereinafter called as emulsion layers) being substantially the same in color sensitiveness but different in sensitivity. In this invention, the above-mentioned "substantially the same in color sensitiveness" means that, for instance, any of low sensitivity silver halide emulsion layer, medium sensitivity silver halide emulsion layer and high sensitivity silver halide emulsion layer layer has a light-sensitivity to any of the wavelength region of spectral wavelength regions such as blue color region, green color region and red color region. Even when the light-sensitivity may differ between the layers slightly with respect to a certain wavelength region, such light-sensitive layers are deemed to be substantially the same in color sensitiveness.

Also, in this invention, the light-sensitive layer contains a dye image forming coupler, and at the same time constitued of a plurality of emulsion layers with different sensitivities. In the following, description is made about a preferred embodiment of this invention for illustration of the invention which is constituted by arranging a low sensitivity emulsion layer, a medium sensitivity emulsion layer and a high sensitivity emulsion layer successively in this order from the support side.

The maximum color-formed density in the above medium sensitivity emulsion layer in the light-sensitive material according to this invention is larger than 0.6 and smaller than 1.2, preferably 0.7 to 1.0. The reason for defining the density range is that is was found as a result of detailed study about a number of actually photographed prints photographed by use of a color-nega light-sensitive material for general purpose and the nega image densities of the corresponding nega light-sensitive materials, that the nega density of a scene where graininess is most conspicuous is at the gradation region within the range from fog +4 to 1.3. Based on the above finding, it is preferred that the maximum color-formed density in the above high sensitivity emulsion layer according to this invention is lower than the above density in the medium sensitivity emulsion layer. It is also preferred that the maximum color-formed density is within the range from 0.3 to 0.6.

The maximum color-formed density in this invention refers to the maximum density possessed by a layer obtained when subjected to the developing processing as described below. Exposure of the emulsion layer is effected with a light passed through a filter having the wavelength region matching to the color sensitiveness of the emulsion layer and dosage is set so as to give the maximum density. The densitometer employed for measurement is produced by Macbeth Co. (using Status M filter).

| Developing processing step (38° C.) | Processing time |
|---|---|
| Color developing | 3 min. 15 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 1 min. 30 sec. |

The processing solutions employed in the respective processing steps had the compositions shown below.

| | |
|---|---|
| Composition of color developing solution: | |
| 4-Amino-3-methyl-N—ethyl-N—(β-hydroxyethyl)-aniline sulfate | 4.8 g |
| Anhydrous sodium sulfite | 0.14 g |
| Hydroxylamine ½ sulfate | 1.98 g |
| Sulfuric acid | 0.74 g |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Sodium chloride | 0.14 g |
| Nitrilotriacetic acid trisodium salt (monohydrate) | 1.20 g |
| Potassium hydroxide | 1.48 g |
| (made up to one liter with addition of water) | |
| Composition of bleaching solution: | |
| Ferric ammonium salt of ethylenediamine- | 100.0 g |

-continued

| | |
|---|---|
| tetraacetic acid | |
| Diammonium salt of ethyelediamine-tetraacetic acid | 10.0 g |
| Ammonium bromide | 150.0 g |
| Glacial acetic acid | 10.0 ml |
| (made up to one liter with addition of water and adjusted to pH 6.0 with ammonia water) | |
| Composition of fixing solution: | |
| Ammonium thiosulfate | 175.0 g |
| Anhydrous sodium sulfite | 8.6 g |
| Sodium metasulfite | 2.3 g |
| (made up to one liter with addition of water and adjusted to pH 6.0 with acetic acid) | |
| Composition of stabilizing solution: | |
| Formalin (37% aqueous solution) | 1.5 ml |
| Konidax (produced by Konishiroku Photo Industry Co., Ltd.) | 7.5 ml |
| (made up to one liter with addition of water.) | |

Also, according to this invention, the density of the dye image forming coupler in the medium emulsion layer is required to be 10 to 60%, preferably in the range from 20 to 40%, of the density of the dye image forming coupler in the low sensitivity emulsion layer. Further, the above coupler density in the high sensitivity emulsion layer, which can freely be determined, may preferably be 5 to 40%, more preferably in the range from 10 to 30%, of the coupler density in the low sensitivity emulsion layer.

The above coupler density as herein mentioned means the value obtained by dividing total moles of the dye image forming coupler contained in an emulsion layer having a certain sensitivity with the amount employed (weight) of the hydrophilic colloidal binder in the emulsion layer having the certain sensitivity.

Further, in this invention, in addition to the above improvement, a non-sensitive intermediate layer is provided by coating between the medium sensitivity emulsion layer and the low sensitivity emulsion layer. The non-sensitive intermediate layer is constituted primarily of a hydrophilic binder, which may further incorporate, if desired, typically a coupler dispersion, an oil dispersion, etc., and also a hydroquinone derivative, a colorless coupler, micropulverized silver halide, etc. The non-sensitive intermediate layer in this invention may have a film thickness of 0.2μ to 3.0μ, preferably 0.5 to 2.0μ.

It is also possible to additionally provide a non-sensitive intermediate layer between the high sensitivity emulsion layer and the medium sensitivity emulsion layer.

The low sensitivity silver halide emulsion layer, medium sensitivity silver halide emulsion layer and high sensitivity silver halide emulsion layer may each have a filim thichness of 0.5 to 10μ, preferably 1.5 to 6μ.

According to this invention, in addition to the improvement brought about by making greater the maximum color-formed density in the medium sensitivity emulsion layer according to this invention and making smaller the coupler density in said emulsion layer, an unexpected improved effect can be obtained concerning improvement of graininess by provision of a non-sensitive intermediate layer between the medium sensitivity emulsion layer and the low sensitivity emulsion layer. Also, according to this invention, pressure fogging resistance can be improved together with the above effect in the light-sensitive material of this invention having the constitution as described above, whereby image quality and fog can be improved at the same time.

Next, in the light-sensitive material of this inventon, the difference in light-sensitivity beween the high sensitivity emulsion layer and the medium sensitivity emulsion layer can be determined optimally according to the known method in consideration of gradation, etc., but it is generally preferred to have a difference of 0.2 to 1.0 log E (E: dosage of exposure), and the sensitivity difference between the high sensitivity emulsion layer and the low sensitivity emulsion layer region may preferably be 1.0 to 2.0 log E.

For enhancement of the effect of this invention, it is preferable to incorporate a compound which can react with the oxidized product of a developing agent to release a development inhibitor (hereinafter referred to as DIR compound) in at least one of the high sensitivity emulsion layer, the medium sensitivity emulsion layer, the low sensitivity emulsion layer and the intermediate layer sandwitched between these layers. DIR compounds are described in detail in, for instance, U.S. Pat. No. 3,227,554 and Japanese Unexamined Patent Publication No. 145135/1979. DIR compounds may be employed in an amount up to 2 mg/dm$^2$ in the above constituent layer, preferably up to 0.1 to 0.9 mg/dm$^2$.

These DIR compounds should particularly preferably be so selected as to have a large reaction rate for the high sensitivity layer, while a small reaction rate for the low sensitivity emulsion layer, in order to enhance the effect of this invention.

Specifically, the above DIR compound is represented by the formula:

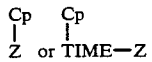

wherein Cp represents a coupling component reactive with an oxidized product of an aromatic primary amine color developing agent, TIME represents a timing group which releases Z after the coupling reaction of Cp and Z represents a development inhibitor.

The development inhibitor represented by Z is shown by the formula [$Z_1$] or [$Z_2$] shown below:

Formula [$Z_1$]

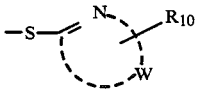

wherein W represents oxygen atoms, sulfur atoms, nitrogen atoms and carbon atoms necessary for formation of a five-membered heterocyclic ring; and $R_{10}$ represents a hydrogen atom, an alkyl group, an aryl group, an alkoxy group, an amino group or a heterocyclic group.

Formula [$Z_2$]

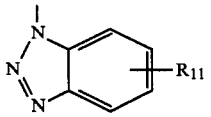

wherein $R_{11}$ represents benzothiazolinidene amino group.

The timing group represented by TIME is a compound represented by the following formulate [$T_1$], [$T_2$] or [$T_3$]:

Formula [$T_1$]

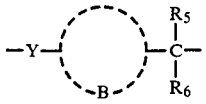

wherein B represents a group of atoms necessary for completion of a benzene ring or a naphthalene ring; Y represents —O—, —S—,

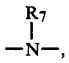

which is bonded to the active site of Cp; $R_5$, $R_6$ and $R_7$ each represents a hydrogen atom, an alkyl group or an aryl group; and the group

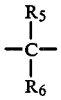

is substituted at an ortho position or a para position relative to Y and bonded to a hetero atom included in Z;

Formula [$T_2$]

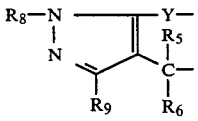

wherein Y, $R_5$ and $R_6$ have the same meanings as defined in the formula [$T_1$]; $R_8$ represents a hydrogen atom, an alkyl group, an aryl group, an acyl group, a sulfone group, an alkoxycarbonyl group or a heterocyclic ring residue; and $R_9$ represents a hydrogen atom, an alkyl group, an aryl group, a heterocylic ring residue, an alkoxy group, an amino group, an acid amide group, a sulfonamide group, a carboxylic group, an alkoxycarbonyl group, a carbamoyl group or a cyano group, said timing group being bonded through Y to the active site of Cp and through

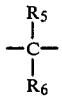

group to a hetero atom in Z; or

Formula [$T_3$]

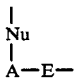

wherein Nu is a nucleophilic group having an oxygen, sulfur or nitrogen atom enriched in electrons and bonded to the coupling position of Cp; E is an electrophilic group having a carbonyl group, a thiocarbonyl group, a phosphinyl group or a thiophosphinyl group and bonded to a hetero atom in Z; and A is a steric correlation between Nu and E, and it is a bonding group which is subject to an intramolecular nucleophilic reaction accompanied with formation of a three- to sevenmembered ring after Nu has been released from Cp and can release Z through said nucleophilic reaction.

Preferably, the DIR compound used in this invention is a compound of the formula (I):

Formula (I)

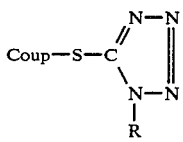

In the above formula, Coup represents a coupler component capable of forming a dye through coupling with the oxidized product of a color developing agent, and R represents an alkyl group, preferably an alkyl group having 1 to 4 carbon atoms. Examples of the above alkyl group are methyl, ethyl, i-propyl, n-propyl, n-butyl, sec-butyl, tert-butyl and the like. The above alkyl may further have substituents, preferably such as methoxy, ethoxy, hydroxy, carboxyl, etc.

In the following, typical examples of the compounds represented by the above formula are shown below, but this invention is not limited only to these.

[Exemplary Compounds]

D-1

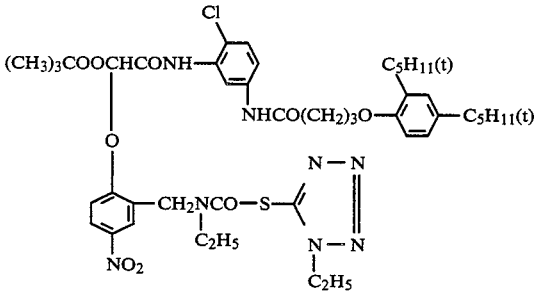

D-2

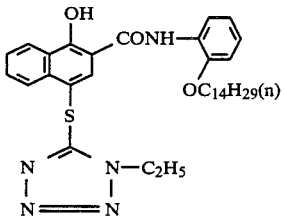

D-3

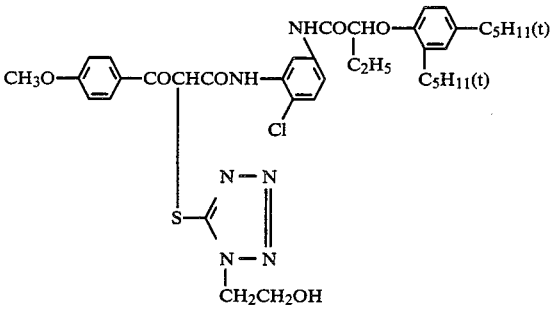

-continued

[Exemplary Compounds]

D-4

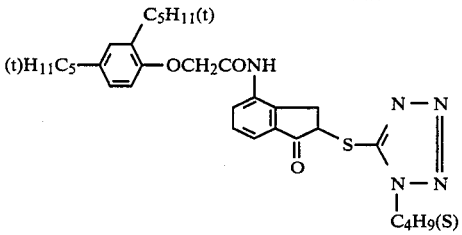

D-5

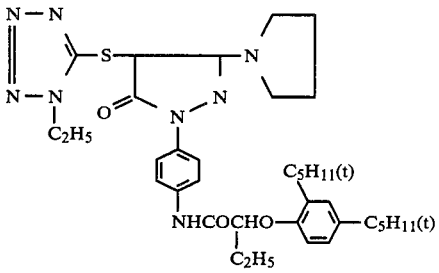

D-6

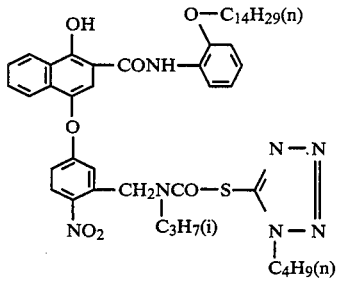

D-7

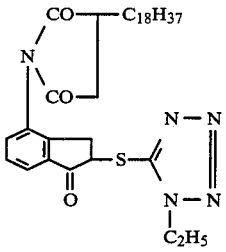

D-8

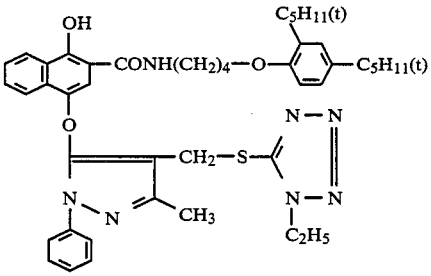

D-9

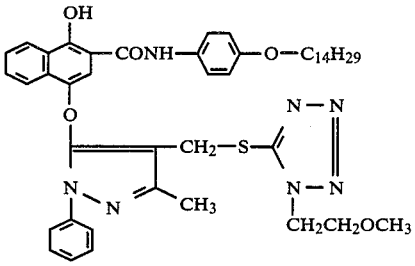

-continued

[Exemplary Compounds]

D-10

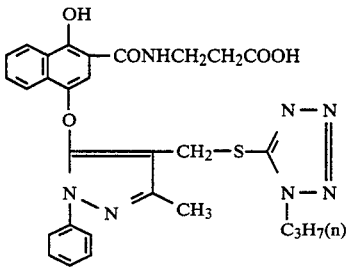

D-11

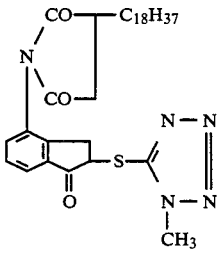

D-12

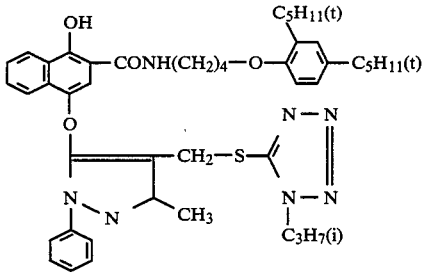

D-13

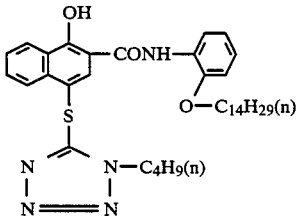

D-14

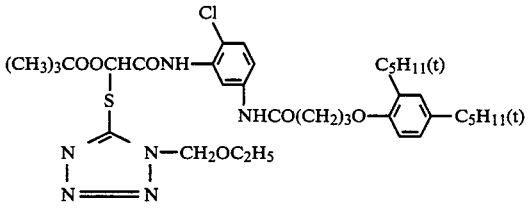

D-15

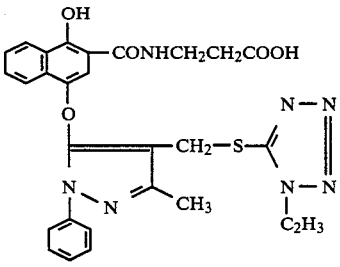

-continued

[Exemplary Compounds]

D-16

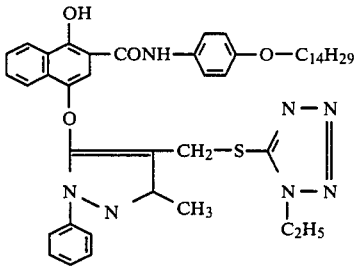

D-17

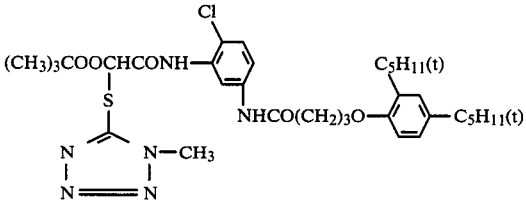

D-18

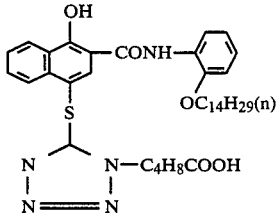

D-19

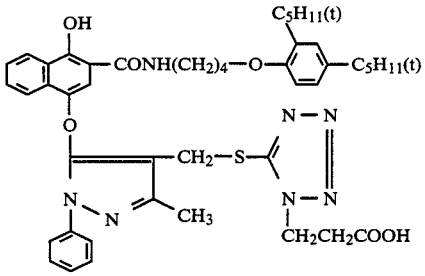

Next, in this invention, the dye image forming coupler to be used in the high sensitivity emulsion layer and the non-sensitive intermediate layer may be chosen suitably depending on the coupling speed, but those shown below may preferably be used.

The dye image forming cyan coupler to be used in this invention may peferably be a phenol type compound and a naphthol type compound, which can be selected from those disclosed in, for instance, U.S. Pat. Nos. 2,369,929; 2,434,272; 2,474,292; 2,895,826; 3,253,924; 3,034,892; 3,311,476; 3,386,301; 3,419,390; 3,458,315; 3,476,563; and 3,519,383. The methods for preparation of these compounds are also disclosed in these publications.

Specific examples of particularly useful cyan couplers are set forth below.

C-1: 1-hydroxy-N-[δ-(2,4-di-t-amylphenoxy)butyl]-2-naphthoamide;

C-2: 1-hydroxy-N-[γ-(2,4-di-t-amylphenoxy)propyl]-2-naphthoamide;

C-3: 2,4-dichloro-3-methyl-6-(2,4-di-t-amylphenoxyacetamido)phenol;

C-4: 2,4-dichloro-3-methyl-6-[α-(2,4-di-t-amylphenoxy)-butylamido]phenol;

C-5: 2-perfluorobutylamido-5-[α-(2,4-di-t-amylphenoxy)-hexaneamido]phenol;

C-6: 1-hydroxy-4-(octadecylsuccinimido)-N-ethyl-3',5'-dicarboxy-2-naphthoamide;

C-7: 1-hydroxy-4-(anilinocarbonyloxy-N-[δ-(2,4-di-tert-amylphenoxy)butyl]-2-naphthoamide;

C-8: 1,2-bis-{4-hydroxy-3-[N-[δ-(2,4-di-tert-amylphenoxy)butyl]carbamoyl]-1-naphthyloxycarbamino}-ethane;

C-9: 1-hydroxy-4-(ethoxycarbonylmethoxy)-N-[δ-(2,4-di-tert-amyl)butyl]-2-naphthoamide;

C-10: 1-hydroxy-4-[β-methoxyethylaminocarbonylmethoxy)-N-[δ-(2,4-di-tert-amylphenoxy)butyl]-2-naphthoamide;

C-11: 2-chloro-3-methyl-4-carboxymethoxy-6-[β-(2,4-di-tert-amylphenoxy)butyroyl]-phenol;

C-12: 1-hydroxy-4-methoxycarbonyloxy-N-dodecyl-2-naphthoamide;

C-13: 1-hydroxy-4-(4-toluenesulfonamido)-N-[δ-(2,4-di-tert-amylphenoxy)butyl]-2-naphthoamide;

C-14: 1-hydroxy-4-(1-naphthylaminocarbonyloxy)-N-[δ-(2,4-di-tert-amylphenoxy)butyl]-2-naphthoamide;

C-15: 1-hydroxy-4-[α-(β-methoxyethoxycarbonyl)ethoxy]-N-[δ-(2,4-di-tert-amylphenoxy)butyl]-2-naphthoamide;

C-16: 1-hydroxy-4-[4-(β-carboxypropaneamido)-phenoxy]-2-{N-[δ-(2,4-di-tert-amylphenoxy)-butylamino]}-naphthoic acid amide;

C-17: 1-hydroxy-4-(β-methylsulfonylmethoxy)-2-(N-hexadecyl)-naphthoic acid amide.

It is also possible to use a colored cyan coupler, and in this case a phenol or naphthol derivative is generally used. Their examples are disclosed in, for instance, U.S. Pat. Nos. 2,521,908 and 3,034,892; U.K. Pat. No. 1,255,111; Japanese Unexamined Patent Publications Nos. 22028/1973, 123341/1975 and 10135/1975; and U.S. Pat. No. 3,476,563, together with the synthetic methods thereof.

Specific examples of the colored cyan coupler advantageously used in this invention are shown below.

CC-1: 1-hydroxy-4-(2-acetylphenylazo)-N-[δ-(2,4-di-t-amylphenoxy)butyl]-2-naphthoamide;

CC-2: 1-hydroxy-4-[2-(β-phenylpropionyl)phenylazo]-N-[δ-(2,4-di-t-amylphenoxy)butyl]-2-naphthoamide;

CC-3: 1-hydroxy-4-phenylazo-4'-(4-t-butylphenoxy)-2-naphthoanilide;

CC-4: 1-hydroxy-4-[4-(1-hydroxy-8-acetamido-3,6-disulfo-2-naphthylazo)phenoxy]-N-[δ-(2,4-di-t-amylphenoxy)butyl]-2-naphthoamide disodium salt;

CC-5: 1-hydroxy-4-[4-(2-hydroxy-3,6-disulfo-1-naphthylazo)phenylcarbamoyloxy]-N-[δ-(2,4-di-t-amylphenoxy)butyl]-2-naphthoamide disodium salt;

CC-6: 1-hydroxy-4-(2-ethoxycarbonylphenylazo)-N-[δ-(2,4-di-t-amylphenoxy)butyl]-2-naphthoamide.

The dye image forming magenta couplers to be used in this invention may include pyrazolone type, pyrazolotriazole type, pyrazolinobenzimidazole type and indazolone type compounds. The compounds which can advantageously be used in this invention are, as the pyrazolone type magenta couplers, those disclosed in U.S. Pat. Nos. 2,600,788; 3,062,653; 3,127,269; 3,311,476; 3,419,391; 3,519,429; 3,558,318; 3,684,514 and 3,888,680; Japanese Unexamined Patent Publications Nos. 29639/1974, 111631/1974, 129538/1974 and 13041/1975; Japanese Patent Application Nos.24690/1975; 134470/1975 and 156327/1975; as pyrazolotriazole type magenta couplers, those disclosed in U.S. Pat. No. 1,247,493 and Belgian Patent 792,525; as pyrazolinobenzimidazole type magenta couplers, those disclosed in U.S. Pat. No. 3,061,432, German Pat. No. 2,156,111 and Japanese Patent Publication No.60479/1971; further as indazolone type magenta couplers, those disclosed in Belgian Pat. No. 769,116.

Specific examples of particularly useful magenta couplers are set forth below.

M-1: 1-(2,4,6-trichlorophenyl)-3-[3-(2,4-di-t-amylphenoxyacetamido)benzamido]-5-pyrazolone;

M-2: 1-(2,4,6-trichlorophenyl)-3-(3-dodecylsuccinimidobenzamido)-5-pyrazolone;

M-3: 4,4'-methylenebis{1-(2,4,6-trichlorophenyl)-3-[3-(2,4-di-t-amylphenoxyacetamido)benzamido]-5-pyrazolone};

M-4: 1-(2,4,6-trichlorophenyl)-3-(2-chloro-5-octadecylsuccinimidoanilino)-5-pyrazolone;

M-5: 1-(2-chloro-4,6-dimethylphenyl)-3-{3-[α-(3-pentadecylphenoxy)butylamido]benzamido}-5-pyrazolone;

M-6: 1-(2,4,6-trichlorophenyl)-3-(2-chloro-5-octadecylcarbamoylanilino)-5-pyrazolone;

M-7: 1-(2,4,6-trichlorophenyl)-3-[3-(2,4-di-t-amylphenoxyhexylamido)benzamido]-5-pyrazolone;

M-8: 3-ethoxy-1-{4-[α-(3-pentadecylphenoxy)-butylamido]-phenyl}-5-pyrazolone;

M-9: 1-(2,4,6-trichlorophenyl)-3-[2-chloro-5-tetradecaneamidoanilino]-5-pyrazolone;

M-10: 1-(2,4,6-trichlorophenyl)-3-{2-chloro-5-[α-(3-t-butyl-4-hydroxyphenoxy)tetradecaneamido]anilino}-5-pyrazolone;

M-11: 1-(2,4,6-trichlorophenyl)-3-[3-(2,4-di-t-amylphenoxyacetamido)benzamido]-4-acetoxy-5-pyrazolone;

M-12: 1-(2,4,6-trichlorophenyl)-3-[3-(2,4-di-t-amylphenoxyacetamido)benzamido]-4-ethoxycarbonyloxy-5-pyrazolone;

M-13: 1-(2,4,6-trichlorophenyl)-3-[3-(2,4-di-t-amylphenoxyacetamido)benzamido]-4-(4-chlorocinnamoyloxy)-5-pyrazolone;

M-14: 1-(2,4,6-trichlorophenyl)-3-{3-(4-n-dodecylbenzenesulfonamido)benzamido}-5-pyrazolone;

M-15: 4,4'-benzyldenebis[1-(2,4,6-trichlorophenyl)]-3-{2-chloro-5-[γ-(2,4-di-t-amylphenoxy)butylamido]-anilino}-5-pyrazolone;

M-16: 4,4'-benzyldenebis[1-(2,3,4-5,6-pentachlorophenyl)]-3-{2-chloro-5-[γ-(2,4-di-t-amylphenoxy)-butylamido]anilino}-5-pyrazolone;

M-17: 4,4'-(2-chloro)benzilidenebis[1-(2,4,6-trichlorophenyl)]-3-(2-chloro-5-dodecylsuccinimidoanilino)-5-pyrazolone;

M-18: 4,4'-methylenebis[1-(2,4,6-trichlorophenyl)]-3-{3-[α-(2,4-di-t-amylphenoxy)butylamido]benzamido}-5-pyrazolone.

It is also possible to use a colored magenta coupler and, in this case, a compound arylazo-substituted at the coupling position of the colorless magenta coupler is generally employed. For example, there may be included the compounds as disclosed in U.S. Pat. Nos. 2,801,171; 2,983,608; 3,005,712 and 3,684,514; U.K. Pat. No. 937,621; Japanese Unexamined Patent Publications Nos.123625/1974 and 31448/1974. Further, also available is a colored magenta coupler of the type in which the dye is flown out into a processing solution through the reaction with the oxidized product of a developing agent, as disclosed in U.S. Pat. No. 3,419,391. Specific examples of colored magenta couplers are set forth below.

CM-1: 1-(2,4,6-trichlorophenyl)-4-(4-methoxyphenylazo-3-[3-(2,4-di-t-amylphenoxyacetamido)benzamido]-5-pyrazolone;

CM-2: 1-(2,4,6-trichlorophenyl)-4-(1-naphthylazo)-3-(2-chloro-5-octadecenylsuccinimidoanilino)-5-pyrazolone;

CM-3: 1-(2,4,6-trichlorophenyl)-4-(4-hydroxy-3-methylphenylazo)-3-(2-chloro-5-tetradecaneamidoanilino)-5-pyrazolone;

CM-4: 1-(2,4,6-trichlorophenyl)-4-(4-hydroxy-3-methylphenylazo)-3-(2-chloro-5-octadecenylsuccinimidoanilino)-5-pyrazolone;

CM-5: 1-(2,4,6-trichlorophenyl)-3-{2-chloro-5-[α-(4-hydroxy-3-t-butylphenoxy)tetradecaneamido]-anilino}-4-(1-naphthylazo)-5-pyrazolone;

CM-6: 1-(2,4,6-trichlorophenyl)-3-{2-chloro-5-[α-(2,4-di-t-amylphenoxy)butylamido]anilino}-4-(4-methoxyphenylazo)-5-pyrazolone;

CM-7: 1-(2,4,6-trichlorophenyl)-3-{2-chloro-5-[γ-(2,4-di-t-amylphenoxy)butylamido]anilino}-4-(4-hydroxyphenylazo)-5-pyrazolone;

CM-8: 1-(2,3,4,5,6-pentachlorophenyl)-3-{2-chloro-5-[γ-(2,4-di-t-amylphenoxy)butylamido]-anilino}-4-(4-hydroxyphenylazo-5-pyrazolone.

As the dye image forming yellow coupler to be used in this invention, there have heretofore been used open-chain ketomethylene compounds, and it is possible to employ benzoylacetanilide type yellow couplers and pivaloylacetanilide type yellow couplers which are generally used widely. Further, there have also been advantageously employed divalent type yellow couplers substituted with a substituent of which the carbon atom at the coupling position can be eliminated during the coupling reaction. Examples of these compounds are disclosed together with the synthetic methods thereof in U.S. Pat. Nos. 2,875,057; 3,265,506; 3,664,841; 3,408,194, 3,447,928; 3,277,155; 3,415,652; Japanese Patent Publication No.13576/1974; Japanese Unexamined Patent Publications Nos. 29432/1973, 66834/1973, 10736/1974, 122335/1974, 28834/1975 and 132926/1975.

Specific examples of particularly effective yellow couplers are set forth below.

Y-1: α-(4-carboxyphenoxy)-α-pivalyl-2-chloro-5-[γ-(2,4-di-t-amylphenoxy)butylamido]acetanilide;

Y-2: α-pivalyl-2-chloro-5-[γ-(2,4-di-t-amylphenoxy)-butylamido]acetanilide;

Y-3: α-benzoyl-2-chloro-5-[α-(dodecyloxycarbonyl)-ethoxycarbonyl]acetanilide;

Y-4: α-(4-carboxyphenoxy)-α-pivalyl-2-chloro-5-[α-(3-pentadecylphenoxy)butylamido]acetanilide;

Y-5: α-(1-benzyl-2,4-dioxo-3-imidazolidinyl)-α-pivalyl-2-chloro-5-[γ-(2,4-di-t-amylphenoxy)butylamido]-acetanilide;

Y-6: α-[4-(1-benzyl-2-phenyl-3,5-dioxo-1,2,4-triazolidinyl)]-α-pivalyl-2-chloro-5-[γ-(2,4-di-t-amylphenoxy)butylamido]acetanilide;

Y-7: α-acetoxy-α-{3-[α-(2,4-di-t-amylphenoxy)-butylamido]benzoyl}-2-methoxyacetanilide;

Y-8: α-{3-[α-(2,4-di-t-amylphenoxy)butylamido]benzoyl}-2-methoxyacetanilide;

Y-9: α-[4-(4-benzyloxyphenylsulfonyl)phenoxy]-α-pivalyl-2-chloro-5-[γ-(2,4-di-t-amylphenoxy)-butylamido]acetanilide;

Y-10: α-pivalyl-α-(4,5-dichloro-3(2H)-pyridazo-2-yl)-2-chloro-5-[(hexadecyloxycarbonyl)methoxycarbonyl]-acetanilide;

Y-11: α-pivalyl-α-[4-(p-chlorophenyl)-5-oxo-$\Delta^2$-tetrazolin-1-yl]-2-chloro-5-[α-(dodecyloxycarbonyl)ethoxycarbonyl]acetanilide;

Y-12: α-(2,4-dioxo-5,5-dimethyloxazolidin-3-yl)-α-pivalyl-2-chloro-5-[α-(2,4-di-t-amylphenoxy)-butylamido]acetanilide;

Y-13: α-pivalyl-α-[4-(1-methyl-2-phenyl-3,5-dioxo-1,2,4-triazolidinyl)]-2-chloro-5-[γ-(2,4-di-t-amylphenoxy)butylamido]anilide;

Y-14: α-pivalyl-α-[4-(p-ethylphenyl)-5-oxo-$\Delta^2$-tetrazolin-1-yl-2-chloro-5-[γ-(2,4-di-t-amylphenoxy)-butylamido]acetanilide;

Y-15: α-(4'-methoxybenzoyl)-α-pyrazolyl-2-chloro-5-dodecyloxycarbonylacetanilide.

The amount of the above various couplers to be used in this invention may be generally $2\times10^{-3}$ mole to $5\times10^{-1}$ mole per mole of silver in the light sensitive silver halide emulsion layer, preferably $5\times10^{-3}$ mole to $5\times10^{-2}$ mole in the high sensitivity emulsion layer, $7\times10^{-3}$ mole to $1\times10^{-1}$ mole in the medium sensitivity emulsion layer and $2\times10^{-2}$ mole to $3\times10^{-1}$ mole in the low sensitivity emulsion layer. In the intermediate layer, the amount to be added may be $1\times10^{-6}$ mol/dm$^2$ to $8\times10^{-5}$ mol/dm$^2$, preferably $4\times10^{-6}$/dm$^2$ to $3\times10^{-5}$ mol/dm$^2$.

As the method for dispersing the above various couplers, there may be employed various methods such as the so called alkali aqueous solution dispersing method, the solid dispersing method, the latex dispersing method, oil droplet-in-water type emulsifying method and others, and suitable method may be selected depending on the chemical structure of the above various couplers.

In this invention, the latex dispersing method and the oil droplet-in-water type emulsifying method are particularly suitable. These dispersing methods are well known in the art, and the latex dispersing method and its effect are disclosed in Japanese Unexamined Patent Publications Nos. 74538/191974, 59943/1976 and 32552/1979, Research Disclosure, August, 1976, No.14850, page 77–79.

Suitable latices are homopolymers, copolymers and terpolymers of monomers such as styrene, ethyl acrylate, n-butyl acrylate, n-butyl methacrylate, 2-acetoacetoxyethyl methacrylate, 2-(methacryloyloxy)ethyltrimethylammonium methosulfate, 3-(methacryloyloxy)propane-1-sulfonic acid sodium salt, N-isopropylacrylamide, N-[2-(2-methyl-4-oxopentyl)]acrylamide, 2-acrylamido-2-methylpropane sulfonic acid, etc. As the oil droplet-in-water type emulsifying method, it is possible to apply a method well known in the art in which a hydrophobic additive such as a coupler is dispersed. More specifically, after dissolving a coupler in a single solvent or a solvent mixture of a high boiling organic solvent having a b.p. of 175° C. or higher such as tricresyl phosphate, dibutyl phthalate, etc. and/or a low boiling organic solvent such as ethyl acetate, butyl propionate, etc., the resultant solution is mixed with an aqueous gelatin solution containing a surfactant and then emulsified by means of a high speed rotary mixer or a colloid mill, followed by addition into the silver halide emulsion layer or the intermediate layer, either directly or after removal of the low boiling solvent.

Colorless couplers to be further used in combination in this invention may be selected from those disclosed in U.K. Pat. Nos. 861,138; 914,145; and 1,109,963; Japanese Patent Publication No. 14033/1970; U.S. Pat. No. 3,580,722; and Mitteilungen aus den Forschungs Laboratorien der Agfa Leberkusen, vol. 4, s.352–367 (1964).

The silver halide to be used in this invention may include any one conventionally used in silver halide emulsions such as silver chloride, silver bromide, silver iodide, silver chlorobromide, silver iodobromide, silver chloroiodobromide and the like.

The silver halide grains in these materials may be either coarse grains or fine grains, and the distribution of the grain sizes may be either narrow or broad. The crystals of these silver halide grains may be either normal or twin crystals, and the crystals with any desired ratio of [100] plane to [111] plane may be available. These silver halide grains may have a crystalline structure which is uniform from the inner portion to the outer portion, or a layered structure with different inner and outer layers. Further, these silver halides may be either of the type forming latent images on its surface or of the type forming latent images internally of the grains. These silver halide grains can be prepared according to the known methods conventionally used in this field of the art.

The silver halide emulsion to be used in this invention may be preferably one from which soluble salts have been removed, but it is also possible to use it without removal of the salt. Also, a mixture of two or more kinds of emulsions prepared separately can be used.

As the binder for the silver halide emulsion layer in the light-sensitive material of this invention, there may be employed those known in the art, including, for instance, gelatin, gelatin derivatives such as phenylcarbamylated gelatin, acylated gelatin, phthalated gelatin and the like. These binders may be used as a mixture of two or more compatible kinds, if desired.

The silver halide photographic emulsion having the silver halide grains as described above dispersed in a binder solution can be sensitized with a chemical sensitizer. The chemical sensitizers to be advantageously used in this invention may be classified broadly into the four kinds of noble metal sensitizers, sulfur sensitizers, selenium sensitizers and reducing sensitizers.

Noble metal sensitizers may include gold compounds or compounds of ruthenium, rhodium, palladium, iridium and platinum.

When a gold compound is used, it is also possible to further use ammonium thiocyanate or sodium thiocyanate in combination.

Sulfur sensitizers may include, in addition to active gelatin, sulfur compounds.

Selenium sensitizers may include active and inactive selenium compounds.

As the reducing sensitizers, there may be used monovalent tin salts, polyamine, bisalkylaminosulfide, silane compounds, iminoaminomethanesulfinic acid, hydrazinium salts, hydrazine derivatives, etc.

In the light-sensitive material of this invention, other than the additives as described above, there may also be employed various additives useful for photographic materials such as stabilizers, development accelerators, film hardners, surfactants, staining preventives, lubricants, UV-absorbers, and others.

The light-sensitive material of this invention can also have, in addition to the silver halide emulsion layers, auxiliary layers such as protective layer, intermediate layer, filter layer, halation preventive layer, backing layer, etc. provided therein, if necessary.

The support may be made of various materials known in the art such as plastic films, plastic laminate papers, baryta paper, synthetic paper, etc., which can be suitably selected depending on the purpose of use of the light-sensitive material. These supports are generally applied with subbing treatment for strengthening adhesion to the emulsion layer.

The methods for processing of the light-sensitive material are not particularly limited, but all processing methods are applicable. For example, there may be included a method in which after color developing, bleach-fixing processing is performed, followed further by water washing and stabilizing processing, if desired; a method in which after color developing, bleaching and fixing are performed separately, followed further by water washing and stabilizing processing, if desired; a method in which pre-film hardening, neutralization, color developing, stopping fixing, water washing, bleaching, fixing, water washing, post-film hardening and water washing are performed in the order mentioned; a method in which color developing, water washing, supplementary color developing, stopping, bleaching, fixing, water washing and stabilizing are performed in the order mentioned; the developing method wherein the developed silver formed by color developing is subjected to halogenation bleach, followed by color developing again to increase the amount of the dye formed; or a method in which a low silver content light-sensitive material is processed with the use of an amplifier agent such as peroxide or cobalt complex.

The color developing agent is typically a p-phenylenediamine type compound.

It is also possible to use a color developing agent by incorporating it in the color photographic light-sensitive material. As the precursor for the color developing agent to be used in this invention, there may be applied the color developers of the Schiff base type as disclosed in U.S. Pat. Nos. 2,507,114; 2,695,234; 3,342,599 and Research Disclosure vol. 151, No.15159, Nov., 1979, and those as disclosed in Research Disclosures vol. 129, No. 12924, Oct. 1976; vol. 121, No. 12146, Jun., 1974; and vol. 139, No.13924, Nov., 1975.

Various additives may also be added into the color developing solution, if desired.

This invention is further illustrated by the following Examples, by which this invention is not limited at all, however.

EXAMPLE 1

Green-sensitive emulsions were prepared as described below.

(1) Green-sensitive low sensitivity emulsion-1

A silver iodobromide emulsion containing 6 mol % of silver iodide (mean grain size 0.5$\mu$, containing 0.25 mol of silver halide and 20 g of gelatin per 1 kg of emulsion) was prepared in a conventional manner. 1 kg of this emulsion was chemically sensitized with gold and a sulfur sensitizer, and further, as green-sensitive sensitizing dyes, anhydrous 5,5'-dichloro-9-ethyl-3,3'-di-(3-sulfopropyl)oxacarbocyanine hydroxide; anhydrous 5,5'-diphenyl-9-ethyl-3,3'-di(3-sulfopropyl)oxacarbocyanine; anhydrous 9-ethyl-3,3'-di-(3-sulfopropyl)-5,6,5'6'-dibenzooxacarbocyanine hydroxide were added to the emulsion, followed by addition of 0.25 g of 4-hydroxy- 6-methyl-1,3,3a,7-tetrazaindene. Subsequently, to 1 kg of this emulsion was added 350 ml of the magenta coupler dispersion [M-1] shown below. The thus prepared emulsion is designated as OL-1.

Magenta coupler dispersion [M-1]:

A solution of 35 g of the above exemplary magenta coupler (M-1) and 8 g of the above exemplary colored magenta coupler (CM-2) dissolved in a mixture of 43 g of tricresyl phosphate and 143 ml of ethyl acetate was added into 720 ml of an aqueous 5% gelatin solution containing 4.0 g of sodium triisopropylnaphthalenesulfonate, emulsified in a colloid mill and adjusted to 1000 ml.

(2) Green-sensitive low sensitivity emulsion-2

A silver iodobromide emulsion containing 6 mol % of silver iodide (mean grain size 0.3μ, containing 0.25 mol of silver halide and 20 g of gelatin per 1 kg of emulsion) was chemically sensitized according to the same method as in the above emulsion OL-1, and further to 1 kg of the emulsion was added 350 ml of the above magenta coupler dispersion [M-1]. The thus prepared emulsion is designated as OL-2.

(3) Green-sensitive medium sensitivity emulsion-1

A silver iodobromide emulsion containing 5 mol % of silver iodide (mean grain size 0.8μ, containing 0.25 mol of silver halide and 29 g of gelatin per 1 kg of emulsion) was chemically sensitized according to the same method as in the above emulsion OL-1, and further to 1 kg of the emulsion was added 105 ml of the above magenta coupler dispersion [M-1]. The thus prepared emulsion is designated as OM-1.

(4) Green-sensitive medium sensitivity emulsion-2

A silver iodobromide emulsion containing 6 mol % of silver iodide (mean grain size 0.8μ, containing 0.25 mol of silver halide and 22 g of gelatin per 1 kg of emulsion) was chemically sensitized according to the same method as in the above emulsion OL-1, and further to 1 kg of the emulsion was added 280 ml of the above magenta coupler dispersion [M-1]. The thus prepared emulsion is designated as OM-2.

(5) Green-sensitive high sensitivity emulsion-1

A silver iodobromide emulsion containing 7 mol % of silver iodide (mean grain size 1.3μ, containing 0.25 mol of silver halide and 37 g of gelatin per 1 kg of emulsion) was chemically sensitized according to the same method as in the above emulsion OL-1, and further to 1 kg of the emulsion was added 79 ml of the magenta coupler dispersion [M-2] shown below. The thus prepared emulsion is designated as OH-1.

Magenta coupler dispersion [M-2]:

A solution of 17 g of the above exemplary magenta coupler (M-1) and 17 g of the above exemplary magenta coupler (M-3) dissolved in a mixture of 86 g of tricresyl phosphate and 115 ml of ethyl acetate was added into 750 ml of an aqueous 5% gelatin solution containing 8.5 g of sodium triisopropylnaphthalenesulfonate, emulsified in a colloid mill and adjusted to 1000 ml.

(6) Non-sensitive intermediate layer solution

This solution comprises an aqueous 4% gelatin solution and is designated as IL-1.

By using the respective emulsions OL-1, OL-2, OM-1, OM-2, OH-1 and the intermediate layer solution IL-1, various samples having the constitutions as shown below were prepared by coating supports with these materials.

Sample-1

On a cellulose triacetate film support applied with conventional subbing treatment, successively from the support side, were applied the emulsion OL-1 to a dry film thickness of 4.5μ, the emulsion OM-1 to 1μ, the emulsion OH-1 to 3.2μ.

Sample-2

Coated layers were applied by use of the same emulsions as in Sample-1 except for applying the non-sensitive intermediate layer IL-1 to form an intermediate layer to a dry film thickness of 0.8μ between the coated layer of the emulsion OL-1 and the coated layer of the emulsion OM-1.

Sample-3

On a support, successively from the support side, were applied the emulsion OL-1 to a dry film thickness of 3μ, the non-sensitive intermediate solution IL-1 to 0.8μ, the emulsion OM-2 to 1μ and the emulsion OH-1 to 3.2μ.

Sample-4

Prepared with the same composition as in Sample-3 except for changing the emulsion OM-2 in Sample-3 to the emulsion OM-1 and its dry film thickness to 2.5μ.

Sample-5

Prepared with the same composition as in Sample-4 except for omitting the non-sensitive intermediate layer IL-1 from the above Sample-4. The coupler densities in the respective emulsion layers in Samples 1 to 5 are shown below. The respective coupler densities shown in the following Table are given as values relative to the coupler density in the low sensitivity emulsion layer as 100.

TABLE 1

| | Coupler density | | |
|---|---|---|---|
| Sample | High sensitivity emulsion layer | Medium sensitivity emulsion layer | Low sensitivity emulsion Layer |
| 1 | 15 | 30 | 100 |
| 2 | 15 | 30 | 100 |
| 3 | 15 | 80 | 100 |
| 4 | 15 | 30 | 100 |
| 5 | 15 | 30 | 100 |

Each of the above samples were exposed through a gray wedge with a density difference of 0.15 to green light, and then subjected to processing of the following steps, using the processing solutions shown below.

| Processing step (38° C.) | Processing time |
|---|---|
| Color developing | 3 min. 15 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 1 min. 30 sec. |

The processing solutions employed in the respective processing steps had the compositions shown below.

| | |
|---|---|
| Composition of color developing solution: | |
| 4-Amino-3-methyl-N—ethyl-N—(β-hydroxyethyl)-aniline sulfate | 4.8 g |
| Anhydrous sodium sulfite | 0.14 g |
| Hydroxylamine ½ sulfate | 1.98 g |
| Sulfuric acid | 0.74 g |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Sodium chloride | 0.14 g |
| Nitrilotriacetic acid trisodium salt (monohydrate) | 1.20 g |
| Potassium hydroxide | 1.48 g |
| (made up to one liter with addition of water) | |
| Composition of bleaching solution: | |
| Ferric ammonium salt of ethylenediamine-tetraacetic acid | 100.0 g |
| Diammonium salt of ethyelediamine-tetraacetic acid | 10.0 g |
| Ammonium bromide | 150.0 g |
| Glacial acetic acid | 10.0 ml |
| (made up to one liter with addition of water and adjusted to pH 6.0 with ammonia water) | |
| Composition of fixing solution: | |
| Ammonium thiosulfate | 175.0 g |
| Anhydrous sodium sulfite | 8.6 g |
| Sodium metasulfite | 2.3 g |
| (made up to one liter with addition of water and adjusted to pH 6.0 with acetic acid) | |
| Composition of stabilizing solution: | |
| Formalin (37% aqueous solution) | 1.5 ml |
| Konidax (produced by Konishiroku Photo Industry Co., Ltd.) | 7.5 ml |
| (made up to one liter with addition of water.) | |

The dye wedge obtained by the above processing was subjected to measurement of its density through a green filter of a densitometer produced by Macbeth Co. (using Status M filter).

Further, graininess (RMS) at the density of 0.6 and 1.2 was also measured. Graininess (RMS) is represented by the 1000-fold value of of the standard deviation of fluctuation in density value which occurs during scanning by means of a microdensitometer with a circular scanning orifice diameter of 2.5μ. In the samples obtained, the sensitivities were found to be substantially the same, with gradations being also the same. Besides, the maximum density of the high sensitivity layer, the medium sensitivity layer and the low sensitivity layer combined was 1.8 in each sample. The results obtained are shown in Table 2 below.

TABLE 2

| | Maximum density | | | |
|---|---|---|---|---|
| | High sensitivity emulsion | Medium sensitivity emulsion | Graininess (RMS) | |
| Sample | layer | layer | Fog + 0.4 | Fog + 1.0 |
| 1 | 0.3 | 0.3 | 40 | 55 |
| 2 | 0.3 | 0.3 | 35 | 50 |
| 3 | 0.3 | 0.8 | 60 | 50 |
| 4 | 0.3 | 0.8 | 30 | 20 |
| 5 | 0.3 | 0.8 | 50 | 40 |

As apparently seen also from the above Table, the Sample 4 of this invention, having a non-sensitive intermediate layer between the medium sensitivity emulsion layer and the low sensitivity emulsion layer, with the coupler density in the medium density emulsion layer being within the range as defined in this invention and the maximum color forming density in the medium sensitivity emulsion layer being within the range of from 0.6 to 1.2, is markedly improved in graininess at low density and high density regions. In contrast, in the Sample 1 of Control, while the coupler densities in the high sensitivity emulsion layer and the medium sensitivity emulsion layer are equal to those of the Sample of this invention, the density share is low and therefore coarse grains must be used in the low sensitivity emulsion layer, whereby the graininess in the high density region is markedly deteriorated.

EXAMPLE 2

Red-sensitive emulsions were prepared as described below.

(1) Red-sensitive low sensitivity emulsion—1

A silver iodobromide emulsion containing 5 mol % of silver iodide (mean grain size 0.5μ, containing 0.25 mol of silver halide and 18.5 g of gelatin per 1 kg of emulsion) was prepared in a conventional manner, 1 kg of this emulsion was chemically sensitized with gold and a sulfur sensitizer, and further, as red-sensitive sensitizing dyes, anhydrous 9-ethyl-3,3'-di-(3-sulfopropyl)-4,5,4',5'-dibenzothiacarbocyanine hydroxide; anhydrous 5,5'-dichloro-9-ethyl-3,3'-di-(3-sulfopropyl)-thiacarbocyanine hydroxide; anhydrous 5,5'-dichloro-3',9-diethyl-3-(4-sulfobutyl)oxythiacarbocyanine hydroxide were added to the emulsion, followed by addition of 0.25 g of 4-hydroxy-6-methyl-1,3,3a,7-tetrazaindene. Subsequently, to 1 kg of this emulsion was added 262 ml of the cyan coupler dispersion [C-1] shown below. The thus prepared emulsion is designated as pL-1.

Cyan coupler dispersion [C-1]:

A solution of 45 g of the above exemplary cyan coupler (C-1) and 4.7 g of the above exemplary colored cyan coupler (CC-4) dissolved in a mixture of 25 g of tricresyl phosphate and 167 ml of ethyl acetate was added into 750 ml of an aqueous 5% gelatin solution containing 2.1 g of sodium triisopropylnaphthalenesulfonate, emulsified in a colloid mill and adjusted to 1000 ml.

(2) Red-sensitive low sensitivity emulsion—2

A silver iodobromide emulsion containing 5 mol % of silver iodide (mean grain size 0.3μ, containing 0.25 mol of silver halide and 18.5 g of gelatin per 1 kg of emulsion) was chemically sensitized according to the same method as in the above emulsion pL-1, and further to 1 kg of the emulsion was added 262 ml of the above cyan coupler dispersion [C-1]. The thus prepared emulsion is designated as pL-2.

(3) Red-sensitive medium sensitivity emulsion—1

A silver iodobromide emulsion containing 5 mol % of silver iodide (mean grain size 0.8μ, containing 0.25 mol of silver halide and 20.3 g of gelatin per 1 kg of emulsion) was chemically sensitized according to the same method as in the above emulsion pL-1, and further to 1 kg of the emulsion was added 75.5 ml of the above cyan coupler dispersion [C-1]. The thus prepared emulsion is designated as pM-1.

(4) Red-sensitive medium sensitivity emulsion—2

A silver iodobromide emulsion containing 5 mol % of silver iodide (mean grain size 0.8μ, containing 0.25 mol of silver halide and 17 g of gelatin per 1 kg of emulsion) was chemically sensitized according to the same method as in the above emulsion pL-1, and further to 1 kg of the emulsion was added 162 ml of the above cyan coupler dispersion [C-1]. The thus prepared emulsion is designated as pM-2.

(5) Red-sensitive high sensitivity emulsion—1

A silver iodobromide emulsion containing 6 mol % of silver iodide (mean grain size 1.2μ, containing 0.25 mol of silver halide and 22 g of gelatin per 1 kg of emulsion) was chemically sensitized according to the same method as in the above emulsion pL-1, and further was added thereto 61 ml of the cyan coupler dispersion [C-2] shown below. The thus prepared emulsion is designated as pH-1.

Cyan coupler dispersion [C-2]:

A solution of 23.4 g of the above exemplary cyan coupler (C-1) and 14.9 g of the above exemplary cyan coupler (C-10) dissolved in a mixture of 76 g of tricresyl phosphate and 128 ml of ethyl acetate was added into 760 ml of an aqueous 5% of gelatin solution containing 4.3 g of sodium triisopropylnaphthalenesulfonate, emulsified in a colloid mill and adjusted to 1000 ml.

(6) Red-sensitive high sensitivity emulsion-2

A silver iodobromide emulsion containing 6 mol % of silver iodide (mean grain size 1.2μ, containing 0.25 mol of silver halide and 17.8 g of gelatin per 1 kg of emulsion) was chemically sensitized according to the same method as in the above emulsion pL-1, and further was added thereto 67 ml of the cyan coupler dispersion [C-3] shown below. The thus prepared emulsion is designated as pH-2.

Cyan coupler dispersion [C-3]:

A solution of 17.8 g of the above exemplary cyan coupler (C-1) and 11.4 g of the above exemplary cyan coupler (C-10) dissolved in a mixture of 76.3 g of tricresyl phosphate and 127 ml of ethyl acetate was added into 763 ml of an aqueous 5% gelatin solution containing 4.3 g of sodium triisopropylnaphthalenesulfonate, emulsified in a colloid mill and adjusted to 1000 ml.

By using the respective emulsions pL-1, pL-2, pM-1, pM-2, pH-1 and pH-2 and the non-sensitive intermediate layer solution IL-1, the following samples were prepared by coating supports with these materials.

Sample-6

On a cellulose triacetate film support applied with conventional subbing treatment, successively from the support side, were applied the emulsion pL-1 to a dry film thickness of 4.5μ, the emulsion pM-1 to 1μ, the emulsion pH-1 to 2.8μ.

Sample-7

On the same support as used in the above Sample-6, successively from the support side, were applied the emulsion pL-2 to a dry film thickness of 3μ, the above non-sensitive intermediate layer (IL-1) to 1μ, the emulsion pM-2 to 1.3μ, the emulsion pH-1 to 2.8μ.

Sample-8

The same coated layer as in the above Sample-7, except for changing the emulsion pM-2 to the emulsion pM-1 with a dry film thickness of 2.5μ, was applied.

Sample-9

The same coated layer as in the above Sample-8, except for changing the emulsion pH-1 to the emulsion pH-2 with a dry film thickness of 2.8μ, was applied.

The coupler densities in the respective emulsion layers in Samples 6 to 9 are shown below. The respective coupler densities shown in the following Table are given as values relative to the coupler density in the low sensitivity emulsion layer as 100.

TABLE 3

| | Coupler density | | |
|---|---|---|---|
| Sample | High sensitivity emulsion layer | Medium sensitivity emulsion layer | Low sensitivity emulsion Layer |
| 6 | 20 | 35 | 100 |
| 7 | 20 | 75 | 100 |
| 8 | 20 | 35 | 100 |
| 9 | 20 | 35 | 100 |

Each of the above samples were exposed through a gray wedge with a density difference of 0.15 to red light, and then subjected to processing according to the same steps, and using the same processing solutions as in Example 1.

The dye wedge obtained by the above processing was subjected to measurement of its density and graininess (RMS) according to the ssame method as in Example 1. In the samples obtained, the sensitivities were found to be substantially the same, with gradations being also the same. Besides, the maximum density of the high sensitivity layer, the medium sensitivity layer and the low sensitivity layer combined was 1.8 in each sample. The results obtained are shown in Table 4 below.

TABLE 4

| | Maximum density | | | |
|---|---|---|---|---|
| | High sensitivity emulsion | Medium sensitivity emulsion | Graininess (RMS) | |
| Sample | layer | layer | Fog + 0.4 | Fog + 1.0 |
| 6 | 0.4 | 0.3 | 40 | 50 |
| 7 | 0.4 | 0.7 | 45 | 50 |
| 8 | 0.4 | 0.7 | 32 | 25 |
| 9 | 0.4 | 0.7 | 25 | 20 |

As shown in the above Table, the Sample 8 satisfying the requirements of this invention exhibits excellent graininess in both low density region and high density region. And, in the Sample 9 containing a DIR coupler in the high sensitivity emulsion layer of the above Sample 8, graininess in the low density region and high density region was found to be further improved.

EXAMPLE 3

A cellulose triacetate film applied with conventional subbing treatment was coated with a halation preventive layer containing colloidal silver, and the emulsion layers as described below were overlayed by coating to prepare three kinds of samples.

Sample-10

The following coated layers were applied in the order from the support side.

(1) Red-sensitive emulsion layer having the same composition as the Sample 6 in the above Example 2 (successively from the support side, pL-1 with a dry film thickness of 4.5μ, pM-1 of 1μ and pH-1 of 2.8μ);

(2) Gelatin intermediate layer with a dry film thickness of 1μ;

(3) Green-sensitive emulsion layer having the same composition as the Sample 1 in the above Example 1 (successively from the support side, OL-1 with a dry film thickness of 4.5μ, OL-2 of 1μ and OH-1 of 3.2μ);

(4) Yellow filter layer comprising yellow colloidal silver with a dry film thickness of 1.2μ;

(5) Blue-sensitive emulsion layer containing the above exemplary yellow coupler (Y-2) with a dry film thickness of 3μ;

(6) Gelatin protective layer containing a matte agent with a dry film thickness of 1.5μ.

Sample-11

The following coated layers were applied in the order from the support side.

(1) Red-sensitive emulsion layer having the same composition as the Sample 7 in the above Example 2 (successively from the support side, pL-2 with a dry film thickness of 3μ, IL-1 of 1μ, pM-2 of 1.3μ and pH-1 of 2.8μ);

(2) Gelatin intermediate layer with a dry film thickness of 1μ;

(3) Green-sensitive emulsion layer having the same composition as the Sample 3 in the above Example 1 (successively from the support side, OL-1 with a dry film thickness of 3μ, IL-1 of 0.8μ, OM-2 of 1μ and OH-1 of 3.2μ);

(4) Yellow filter layer comprising yellow colloidal silver with a dry film thickness of 1.2μ;

(5) The same blue-sensitive emulsion as in the above Sample-10;

(6) The same protective layer as in the above Sample-10.

Sample-12

The following coated layers were applied in the order from the support side.

(1) Red-sensitive emulsion layer having the same composition as the Sample 8 in the above Example 2 (successively from the support side, pL-2 with a dry film thickness of 3μ, IL-1 of 1μ, pM-1 of 2.5μ and pH-1 of 2.8μ);

(2) Gelatin intermediate layer with a dry film thickness of 1μ;

(3) Green-sensitive emulsion layer having the same composition as the Sample 4 in the above Example 1 (successively from the support side, OL-1 with a dry film thickness of 3μ, IL-1 of 0.8μ, OM-1 of 2.5μ and OH-1 of 3.2μ);

(4) Yellow filter layer comprising yellow colloidal silver with a dry film thickness of 1.2μ;

(5) The same blue-sensitive emulsion as in the above Sample-10;

(6) The same protective layer as in the above Sample-10.

The respective samples 10, 11 and 12 were subjected to the bending test (with a curvature radius of bending of 2 mm) according to the method as described in Journal of Photographic Society of Japan, vol. 21, page 176 (1958), and then developed according to the same procedure as described in Example 1, followed by measurement of pressure fogging density of the magenta color-formed image. The results of measurement are shown in the Table below.

TABLE 5

| Sample | Pressure fogging density |
|---|---|
| 10 | 0.40 |
| 11 | 0.36 |
| 12 | 0.12 |

Each of the above samples was cut into 35 mm width and packed in a patrone. After the same scene was photographed with a camera, the film was developed similarly as in Example 1 to obtain a nega image. This nega image was enlarged to prepare a print enlarged to 10-fold and its graininess was evaluated with naked eyes.

According to the above results of pressure fogging density and the results of evaluation of graininess with naked eyes, the Sample 12 of this invention was clearly improved in pressure fogging, and its graininess was also found to be good with less roughness of grains as compared with other Control samples.

The light-sensitive material of this invention is excellent in graininess in both low density region and high density region, and its effect can further be enhanced by using in combination a DIR coupler in the high sensitivity layer region. At the same time, it has also an effect for pressure fogging.

What we claim is:

1. A light-sensitive silver halide color photographic material comprising at least one light-sensitive layer, which is constituted of a plurality of silver halide emulsion layers having substantially the same color sensitiveness but being different in sensitivities and contains a dye image-forming coupler, provided by coating on a support, said material being constituted so as to satisfy the four requirements as specified below:

(a) said plurality of silver halide emulsion layers in said light-sensitive layer are provided by coating in the order from the support side, a low sensitivity silver halide emulsion layer, medium sensitivity silver halide emulsion layer and high sensitivity silver halide emulsion layer;

(b) a non-sensitive intermediate layer is provided by coating between said low sensitivity silver halide emulsion layer and said medium sensitivity silver halide emulsion layer;

(c) the density of a dye image-forming coupler in said medium sensitivity silver halide emulsion layer is 10 to 60% of the density of the dye image forming coupler in said low sensitivity silver halide emulsion layer; and (d) the maximum color-formed density (D) in said medium sensitivity silver halide emulsion layer is $0.6 < D < 1.2$.

2. The light-sensitive silver halide color photographic material according to claim 1, wherein said maximum color-formed density (D) in said medium sensitivity silver halide emulsion layer is 0.7 to 1.0.

3. The light-sensitive silver halide color photographic material according to claim 1, wherein the maximum color-formed density in the high sensitivity silver halide emulsion layer is lower than said density in the medium sensitivity silver halide emulsion layer.

4. The light-sensitive silver halide color photographic material according to claim 3, wherein the maximum color-formed density in the high sensitivity silver halide emulsion layer is within the range of from 0.3 to 0.6.

5. The light-sensitive silver halide color photographic material according to claim 1, wherein said density of the dye image-forming coupler in the medium sensitivity silver halide emulsion layer is 20 to 40% of the density of the dye image-forming coupler in the low sensitivity silver halide emulsion layer.

6. The light-sensitive silver halide color photographic material according to claim 1, wherein the density of the dye image forming coupler in said high sensitivity silver halide emulsion layer is 5 to 40% of the density of the dye image forming coupler in the low sensitivity silver halide emulsion layer.

7. The light-sensitive silver halide color photographic material according to claim 1, wherein said non-sensitive intermediate layer has a film thickness of 0.2 to 3.0μ.

8. The light-sensitive silver halide color photographic material according to claim 1, wherein the difference in light-sensitivity between the high sensitivity silver halide emulsion layer and the medium sensitivity silver halide emulsion layer is 0.2 to 1.0 log E.

9. The light-sensitive silver halide color photographic material according to claim 1, wherein the difference in light-sensitivity between the high sensitivity silver halide emulsion layer and the low sensitivity silver halide emulsion layer is 1.0 to 2.0 log E.

10. The light-sensitive silver halide color photographic material according to claim 1, wherein at least one of said high sensitivity silver halide emulsion layer, said medium sensitivity silver halide emulsion layer and said low sensitivity silver halide emulsion layer contains a DIR compound.

11. The light-sensitive silver halide color photographic material according to claim 10, wherein said DIR compound is represented by the formula:

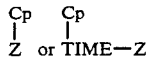

wherein Cp represents a coupling component reactive with an oxidized product of an aromatic primary amine color developing agent, TIME represents a timing group which releases Z after the coupling reaction of Cp and Z represents a development inhibitor.

12. The light-sensitive silver halide color photographic material according to claim 11, wherein said development inhibitor represented by Z is shown by the formula [$Z_1$] or [$Z_2$] shown below:

Formula [$Z_1$]

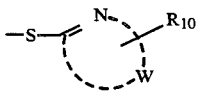

wherein W represents oxygen atoms, sulfur atoms, nitrogen atoms and carbon atoms necessary for formation of a five-membered heterocyclic ring; and $R_{10}$ represents a hydrogen atom, an alkyl group, an aryl group, an alkoxy group, an amino group or a heterocyclic group.

Formula [$Z_2$]

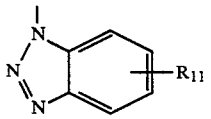

wherein $R_{11}$ represents benzothiazolinidene amino group.

13. The light-sensitive silver halide color photographic material according to claim 11, wherein said timing group represented by TIME is a compound represented by the following formulae [$T_1$], [$T_2$] or [$T_3$]:

Formula [$T_1$]

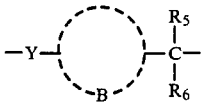

wherein B represents a group of atoms necessary for completion of a benzene ring or a naphthalene ring; Y represents —O—, —S—,

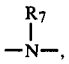

which is bonded to the active site of Cp; $R_5$, $R_6$ and $R_7$ each represents a hydrogen atom, an alkyl group or an aryl group; and the group

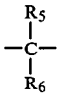

is substituted at an ortho position or a para position relative to Y and bonded to a hetero atom included in Z;

Formula [$T_2$]

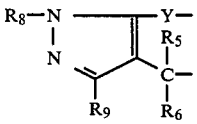

wherein Y, $R_5$ and $R_6$ have the same meanings as defined in the formula [$T_1$]; $R_8$ represents a hydrogen atom, an alkyl group, an aryl group, an acyl group, a sulfone group, an alkoxycarbonyl group or a heterocyclic ring residue; and $R_9$ represents a hydrogen atom, an alkyl group, an aryl group, a heterocyclic ring residue, an alkoxy group, an amino group, an acid amide group, a sulfonamide group, a carboxylic group, an alkoxycarbonyl group, a carbamoyl group or a cyano group, said timing group being bonded through Y to the active site of Cp and through

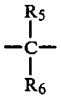

group to a hetero atom in Z; or

Formula [$T_3$]

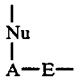

wherein Nu is a nucleophilic group having an oxygen, sulfur or nitrogen atom enriched in electrons and bonded to the coupling position of Cp; E is an electrophilic group having a carbonyl group, a thiocarbonyl group, a phosphinyl group or a thiophosphinyl group and bonded to a hetero atom in Z; and A is a steric correlation between Nu and E, and it is a bonding group which is subject to an intramolecular nucleophilic reaction accompanied with formation of a three- to sevenmembered ring after Nu has been released from Cp and can release Z through said nucleophilic reaction.

14. The light-sensitive silver halide color photographic material according to claim 1, wherein said dye image-forming coupler is contained in an amount of from $2\times10^{-3}$ mole to $5\times10^{-1}$ mole per mole of silver in the light-sensitive silver halide emulsion.

15. The light-sensitive silver halide color photographic material according to claim 14, wherein said dye image-forming coupler is contained in an amount of from $5\times10^{-3}$ mole to $5\times10^{-2}$ mole in the high sensitivity silver halide emulsion layer, from $7\times10^{-3}$ mole to $1\times10^{-1}$ mole in the medium sensitivity silver halide emulsion layer, and from $2\times10^{-2}$ mole to $3\times10^{-1}$ mole in the low sensitivity silver halide emulsion layer.

16. The light-sensitive silver halide color photographic material according to claim 13 wherein said development inhibitor represented by Z is shown by the formula [$Z_1$] or [$Z_2$] shown below:

Formula [$Z_1$]

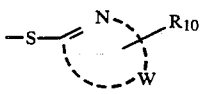

wherein W represents oxygen atoms, sulfur atoms, nitrogen atoms and carbon atoms necessary for formation of a five-membered heterocyclic ring; and $R_{10}$ represents a hydrogen atom, an alkyl group, an aryl group, an alkoxy group, an amino group or a heterocyclic group.

Formula [$Z_2$]

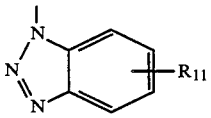

wherein $R_{11}$ represents benzothiazolinidene amino group.

17. The light-sensitive silver halide color photographic material according to claim 16, wherein said maximum color-formed density (D) in said medium sensitivity silver halide emulsion layer is 0.7 to 1.0;

the maximum color-formed density in the high sensitivity silver halide emulsion layer is within the range of from 0.3 to 0.6 and is lower than said density in the medium sensitivity silver halide emulsion layer;

said density of the dye image-forming coupler in the medium sensitivity silver halide emulsion layer is 20 to 40% of the density of the dye image-forming coupler in the low sensitivity silver halide emulsion layer;

the density of the dye image forming coupler in said high sensitivity silver halide emulsion layer is 5 to 40% of the density of the dye image forming coupler in the low sensitivity silver halide emulsion layer;

said non-sensitive intermediate layer has a film thickness of 0.2 to 3.0$\mu$;

the difference in light-sensitivity between the high sensitivity silver halide emulsion layer and the medium sensitivity silver halide emulsion layer is 0.2 to 1.0 log E;

the difference in light-sensitivity between the high sensitivity silver halide emulsion layer and the low sensitivity silver halide emulsion layer is 1.0 to 2.0 log E;

said dye image-forming coupler is contained in an amount of from $2\times10^{-3}$ mole to $5\times10^{-1}$ mole per mole of silver in the light-sensitive silver halide emulsion; and said dye image-forming coupler is contained in an amount of from $5\times10^{-3}$ mole to $5\times10^{-2}$ mole in the high sensitivity silver halide emulsion layer, from $7\times10^{-3}$ mole to $1\times10^{-1}$ mole in the medium sensitivity silver halide emulsion layer, and from $2\times10^{-2}$ mole to $3\times10^{-1}$ mole in the low sensitivity silver halide emulsion layer.

18. The light-sensitive silver halide color photographic material according to claim 1, wherein said maximum color-formed density (D) in said medium sensitivity silver halide emulsion layer is 0.7 to 1.0;

the maximum color-formed density in the high sensitivity silver halide emulsion layer is within the range of from 0.3 to 0.6 and is lower than said density in the medium sensitivity silver halide emulsion layer;

said density of the dye image-forming coupler in the medium sensitivity silver halide emulsion layer is 20 to 40% of the density of the dye image-forming coupler in the low sensitivity silver halide emulsion layer;

the density of the dye image forming coupler in said high sensitivity silver halide emulsion layer is 5 to 40% of the density of the dye image forming coupler in the low sensitivity silver halide emulsion layer;

said non-sensitive intermediate layer has a film thickness of 0.2 to 3.0$\mu$;

the difference in light-sensitivity between the high sensitivity silver halide emulsion layer and the medium sensitivity silver halide emulsion layer is 0.2 to 1.0 log E;

the difference in light-sensitivity between the high sensitivity silver halide emulsion layer and the low sensitivity silver halide emulsion layer is 1.0 to 2.0 log E;

said dye image-forming coupler is contained in an amount of from $2\times10^{-3}$ mole to $5\times10^{-1}$ mole per mole of silver in the light-sensitive silver halide emulsion; and said dye image-forming coupler is contained in an amount of from $5\times10^{-3}$ mole to $5\times10^{-2}$ mole in the high sensitivity silver halide emulsion layer, from $7\times10^{-3}$ mole to $1\times10^{-1}$ mole in the medium sensitivity silver halide emulsion layer, and from $2\times10^{-2}$ mole to $3\times10^{-1}$ mole in the low sensitivity silver halide emulsion layer.

* * * * *